US011346548B2

(12) United States Patent
Khanania

(10) Patent No.: US 11,346,548 B2
(45) Date of Patent: May 31, 2022

(54) BURNER ASSEMBLY AND HEAT EXCHANGER

(71) Applicant: Souhel Khanania, Coppell, TX (US)

(72) Inventor: Souhel Khanania, Coppell, TX (US)

(73) Assignee: Souhel Khanania, Coppell, TX (US)

( * ) Notice: Subject to any disclaimer, the term of this patent is extended or adjusted under 35 U.S.C. 154(b) by 605 days.

(21) Appl. No.: 15/388,796

(22) Filed: Dec. 22, 2016

(65) Prior Publication Data

US 2017/0184311 A1 Jun. 29, 2017

Related U.S. Application Data

(60) Provisional application No. 62/271,834, filed on Dec. 28, 2015.

(51) Int. Cl.

| | |
|---|---|
| ***F23D 14/02*** | (2006.01) |
| ***F23D 14/58*** | (2006.01) |
| ***F23D 23/00*** | (2006.01) |

(52) U.S. Cl.

CPC ..... *F23D 14/02* (2013.01); *F23D 14/58* (2013.01); *F23D 23/00* (2013.01); (Continued)

(58) Field of Classification Search

CPC ..... F28D 1/02; F28D 7/1615; F23D 14/02; F23D 23/00; F23D 14/58; F23D 2900/14003; F23D 2900/00003; F23D 2900/21003; F23C 2900/03005

USPC ... 431/278, 284, 285, 349, 354, 355, 8, 266; 165/7, 177, 185, 153, 150, 172; 126/39 E, 273 R, 41 R, 40

See application file for complete search history.

(56) References Cited

U.S. PATENT DOCUMENTS

| | | | |
|---|---|---|---|
| 1,127,899 | A | 2/1915 | Koppitz et al. |
| 1,630,309 | A | 5/1927 | Pitman |

(Continued)

FOREIGN PATENT DOCUMENTS

| | | | |
|---|---|---|---|
| CH | 106654 | A | 10/1924 |
| DE | 102008055981 | A1 | 5/2010 |

(Continued)

OTHER PUBLICATIONS

Office Action dated Dec. 28, 2018; U.S. Appl. No. 15/388,941, filed Dec. 22, 2016; 29 pages.

(Continued)

*Primary Examiner* — Jorge A Pereiro
*Assistant Examiner* — Logan P Jones
(74) *Attorney, Agent, or Firm* — Conley Rose, P.C.; J. Robert Brown, Jr.

(57) ABSTRACT

Systems and methods are disclosed that include providing a cooking system that comprises a burner assembly and a heat exchanger, the burner assembly having a high velocity burner configured to provide the necessary high velocity, volumetric flowrate through the heat exchanger having a first fluid circuit having a plurality of compactly-arranged tubes disposed perpendicularly and interstitially to a second fluid circuit having a plurality of compactly-arranged tubes, and the burner assembly also having a low velocity burner configured to significantly reduce and/or substantially eliminate "lift off" that could result from operation of only the high velocity burner.

14 Claims, 9 Drawing Sheets

(52) U.S. Cl.
CPC ..... *F23C 2900/03005* (2013.01); *F23D 2900/00003* (2013.01); *F23D 2900/14003* (2013.01); *F23D 2900/21003* (2013.01)

(56) References Cited

U.S. PATENT DOCUMENTS

| | | | | | |
|---|---|---|---|---|---|
| 1,991,631 | A | | 2/1935 | Sangster | |
| 2,212,905 | A | | 8/1940 | Tota | |
| 2,243,661 | A | | 5/1941 | Tota | |
| 2,290,784 | A | | 7/1942 | Turpin | |
| 2,429,360 | A | | 10/1947 | Kells | |
| 2,533,143 | A | * | 12/1950 | Scharbau | F23D 14/58 431/286 |
| 2,666,427 | A | | 1/1954 | Keating | |
| 2,788,848 | A | | 4/1957 | Furczyk | |
| 2,824,604 | A | * | 2/1958 | Reed | F23D 14/26 431/349 |
| 3,002,553 | A | * | 10/1961 | Reed | F23D 14/00 431/349 |
| 3,065,741 | A | | 11/1962 | Gerard | |
| 3,333,123 | A | | 7/1967 | Baumann | |
| 3,351,041 | A | | 11/1967 | Watson et al. | |
| 3,483,920 | A | | 12/1969 | Heyn et al. | |
| 3,773,019 | A | | 11/1973 | Hapgood | |
| 3,782,118 | A | | 1/1974 | Butter et al. | |
| 3,831,560 | A | | 8/1974 | Kuhnlein | |
| 3,843,313 | A | | 10/1974 | Helgeson | |
| 3,850,571 | A | * | 11/1974 | Zink | F23D 14/26 431/349 |
| 3,990,433 | A | | 11/1976 | Keating | |
| 4,202,182 | A | | 5/1980 | Kawashima et al. | |
| 4,253,821 | A | | 3/1981 | Bradshaw | |
| 4,373,504 | A | | 2/1983 | Day | |
| 4,466,482 | A | | 8/1984 | Dorazio et al. | |
| 4,475,587 | A | | 10/1984 | Vasiliev et al. | |
| 4,615,895 | A | | 10/1986 | Bhattacharjee | |
| 4,702,693 | A | | 10/1987 | Frailoi | |
| 4,786,247 | A | | 11/1988 | Bhattacharjee | |
| 4,825,846 | A | | 5/1989 | Frailoi | |
| 4,858,592 | A | * | 8/1989 | Hayek | A47J 37/1247 126/391.1 |
| 4,889,103 | A | | 12/1989 | Frailoi | |
| 5,137,740 | A | | 8/1992 | Benson et al. | |
| 5,209,218 | A | | 5/1993 | Daneshvar et al. | |
| 5,230,796 | A | | 7/1993 | Ter Meulen | |
| 5,287,919 | A | | 2/1994 | George, II et al. | |
| 5,318,438 | A | | 6/1994 | Sugahara et al. | |
| 5,540,215 | A | | 7/1996 | Fritzsche et al. | |
| 5,690,166 | A | | 11/1997 | Yamaguchi | |
| 5,779,465 | A | * | 7/1998 | Clarke | F23D 14/22 126/91 A |
| 5,901,641 | A | * | 5/1999 | McNamara | F28F 13/12 126/391.1 |
| 6,103,118 | A | * | 8/2000 | Ter Meulen | B01D 61/36 210/321.79 |
| 6,315,552 | B1 | | 11/2001 | Haynes | |
| 6,837,234 | B2 | | 1/2005 | Rabas et al. | |
| 7,040,385 | B2 | | 5/2006 | Higashiyama | |
| 7,303,777 | B2 | | 12/2007 | Baas et al. | |
| 9,074,765 | B2 | | 7/2015 | Armanni | |
| 2004/0250810 | A1 | * | 12/2004 | Schultz | F23D 14/58 126/11 OR |
| 2005/0056270 | A1 | | 3/2005 | Babington | |
| 2006/0177788 | A1 | | 8/2006 | Kang et al. | |
| 2007/0042306 | A1 | * | 2/2007 | Bacon | E21B 43/243 431/268 |
| 2007/0089732 | A1 | | 4/2007 | Ricord et al. | |
| 2007/0254254 | A1 | | 11/2007 | Gehring et al. | |
| 2008/0022994 | A1 | * | 1/2008 | Hutchinson | A47J 37/129 126/378.1 |
| 2009/0061369 | A1 | | 3/2009 | Wang et al. | |
| 2010/0081098 | A1 | | 4/2010 | D'Agostini et al. | |
| 2010/0139885 | A1 | | 6/2010 | Hoffman et al. | |
| 2012/0121771 | A1 | | 5/2012 | Jones | |
| 2013/0025546 | A1 | | 1/2013 | Okamoto et al. | |
| 2013/0213385 | A1 | | 8/2013 | O'Donnell et al. | |
| 2013/0260323 | A1 | | 10/2013 | Hong et al. | |
| 2013/0312700 | A1 | * | 11/2013 | Oda | F23D 14/02 123/295 |
| 2014/0080072 | A1 | | 3/2014 | Smirnov et al. | |
| 2014/0165991 | A1 | | 6/2014 | Noman et al. | |
| 2015/0128926 | A1 | | 5/2015 | Noman et al. | |
| 2017/0131034 | A1 | | 5/2017 | Ribarov et al. | |

FOREIGN PATENT DOCUMENTS

| | | | | | |
|---|---|---|---|---|---|
| EP | 0859199 | B1 | | 10/2004 | |
| EP | 2160966 | A1 | | 3/2010 | |
| GB | 599536 | A | * | 3/1948 | F23D 14/10 |
| GB | 599536 | A | | 3/1948 | |
| GB | 934339 | A | * | 8/1963 | F23D 14/26 |
| GB | 934339 | A | | 8/1963 | |
| GB | 1311752 | A | | 3/1973 | |
| GB | 2032611 | A | | 5/1980 | |
| JP | 5792643 | A | | 6/1982 | |
| JP | 2004308945 | A | * | 11/2004 | |
| JP | 2005061688 | A | | 3/2005 | |
| JP | 2006132826 | A | | 5/2006 | |
| WO | 9617672 | A1 | | 6/1996 | |
| WO | 2015085098 | A1 | | 6/2015 | |

OTHER PUBLICATIONS

PCT International Search Report; Application No. PCT/US2016/068358; dated Apr. 14, 2017; 3 pages.
PCT Written Opinion of the International Searching Authority; Application No. PCT/US2016/068358; dated Apr. 14, 2017; 11 pages.
PCT International Search Report; Application No. PCT/US2016/068383; dated Mar. 30, 2017; 3 pages.
PCT Written Opinion of the International Searching Authority; Application No. PCT/US2016/068383; dated Mar. 30, 2017; 8 pages.
Khanania, Souhel; U.S. Appl. No. 15/388,941, filed Dec. 22, 2016; Title: Burner Assembly and Heat Exchanger; 29 pages.
Khanania, Souhel; U.S. Appl. No. 16/022,390, filed Jun. 28, 2018; Title: Burner Assembly and Systems Incorporating a Burner Assembly; 53 pages.
Office Action dated Sep. 4, 2019; U.S. Appl. No. 15/388,941, filed Dec. 22, 2016; 18 pages.
European Extended Search Report; Application No. 16882436.5; dated Aug. 6, 2019; 7 pages.
European Extended Search Report; Application No. 16882441.5; dated Aug. 19, 2019; 12 pages.
PCT International Search Report & Written Opinion of the International Searching Authority; Application No. PCT/US2019/039271; dated Oct. 18, 2019; 11 pages.
Final Office Action dated Apr. 30, 2019; U.S. Appl. No. 15/388,941, filed Dec. 22, 2016; 20 pages.
Advisory Action dated Jul. 29, 2019; U.S. Appl. No. 15/388,941, filed Dec. 22, 2016; 3 pages.
Khanania, Souhel; U.S. Appl. No. 16/732,967, filed Jan. 2, 2020; Title: Cooking System with Burner Assembly and Heat Exchanger; 38 pages.
Office Action dated Jan. 9, 2020; U.S. Appl. No. 16/022,390, filed Jun. 28, 2018; 37 pages.
Brazilian Office Action; Application No. 1120180133108; Published in IP Gazette May 19, 2020; 6 pages.
Final Office Action dated Sep. 4, 2020; U.S. Appl. No. 16/022,390, filed Jun. 28, 2018; 19 pages.
Office Action dated Jul. 29, 2021; U.S. Appl. No. 16/022,390, filed Jun. 28, 2018; 27 pages.
Office Action dated Jul. 9, 2021; U.S. Appl. No. 16/732,967, filed Jan. 2, 2020; 29 pages.
Australian Office Action; Application No. 2016380160; datec Sep. 20, 2021; 4 pages.
European Examination Report; Application No. 16882436.5; dated Feb. 26, 2021; 4 pages.

(56) References Cited

OTHER PUBLICATIONS

Final Office Action dated Feb. 15, 2022; U.S. Appl. No. 16/732,967, filed Jan. 2, 2020; 46 pages.
Australian Office Action; Application No. 2016380160; dated Mar. 4, 2022; 2 pages.
Australian Office Action; Application No. 2016380160; dated Mar. 31, 2022; 2 pages.
European Examination Report; Application No. 16882436.5; dated Feb. 11, 2022; 4 pages.
European Extended Search Report; Application No. 19825728.9; dated Feb. 11, 2022; 7 pages.
Final Office Action dated Novembers, 2021; U.S. Appl. No. 16/022,390, filed Jun. 28, 2018; 13 pages.
Notice of Allowance dated Jan. 26, 2022; U.S. Appl. No. 16/022,390, filed Jun. 28, 2018; 5 pages.
Australian Office Action; Application No. 2019295701; dated Nov. 17, 2021; 5 pages.

* cited by examiner

BURNER ASSEMBLY AND HEAT EXCHANGER

CROSS-REFERENCE TO RELATED APPLICATIONS

The present application claims priority under 35 U.S.C. 119(e) to U.S. Provisional Patent Application No. 62/271,834 filed on Dec. 28, 2015 by Souhel Khanania, and entitled "Burner Assembly and Heat. Exchanger," the disclosure of which is hereby incorporated by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Food service equipment often includes heat generation equipment and/or heat transfer equipment to produce and/or transfer heat to a cooking medium contained in a cooking vessel for cooking consumables prior to packaging. Such heat generation equipment and/or heat transfer equipment often includes a burner configured to combust an air/fuel mixture to produce heat and a heat exchanger to transfer the heat produced by the burner to the cooking medium. Traditional food service burners and/or heat exchangers may often be inefficient at transferring heat to the cooking medium and/or require frequent monitoring and/or replacement of the cooking medium.

SUMMARY

In some embodiments of the disclosure, a burner assembly is disclosed as comprising a first burner configured to combust an air/fuel mixture at a first flowrate; a second burner configured to combust an air/fuel mixture at a second flowrate, wherein the second flowrate is lower than the first flowrate; and an igniter configured to ignite the air/fuel mixture in each of the first burner and the second burner.

In other embodiments of the disclosure, a cooking system is disclosed as comprising a burner assembly comprising: a first burner configured to combust an air/fuel mixture at a first flowrate; a second burner configured to combust an air/fuel mixture at a second flowrate, wherein the second flowrate is lower than the first flowrate; and an igniter configured to ignite the air/fuel mixture in each of the first burner and the second burner; and a heat exchanger comprising a fluid duct and configured to receive the combusted air/fuel mixture from the first burner and the second burner through the fluid duct.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

Figure 1:
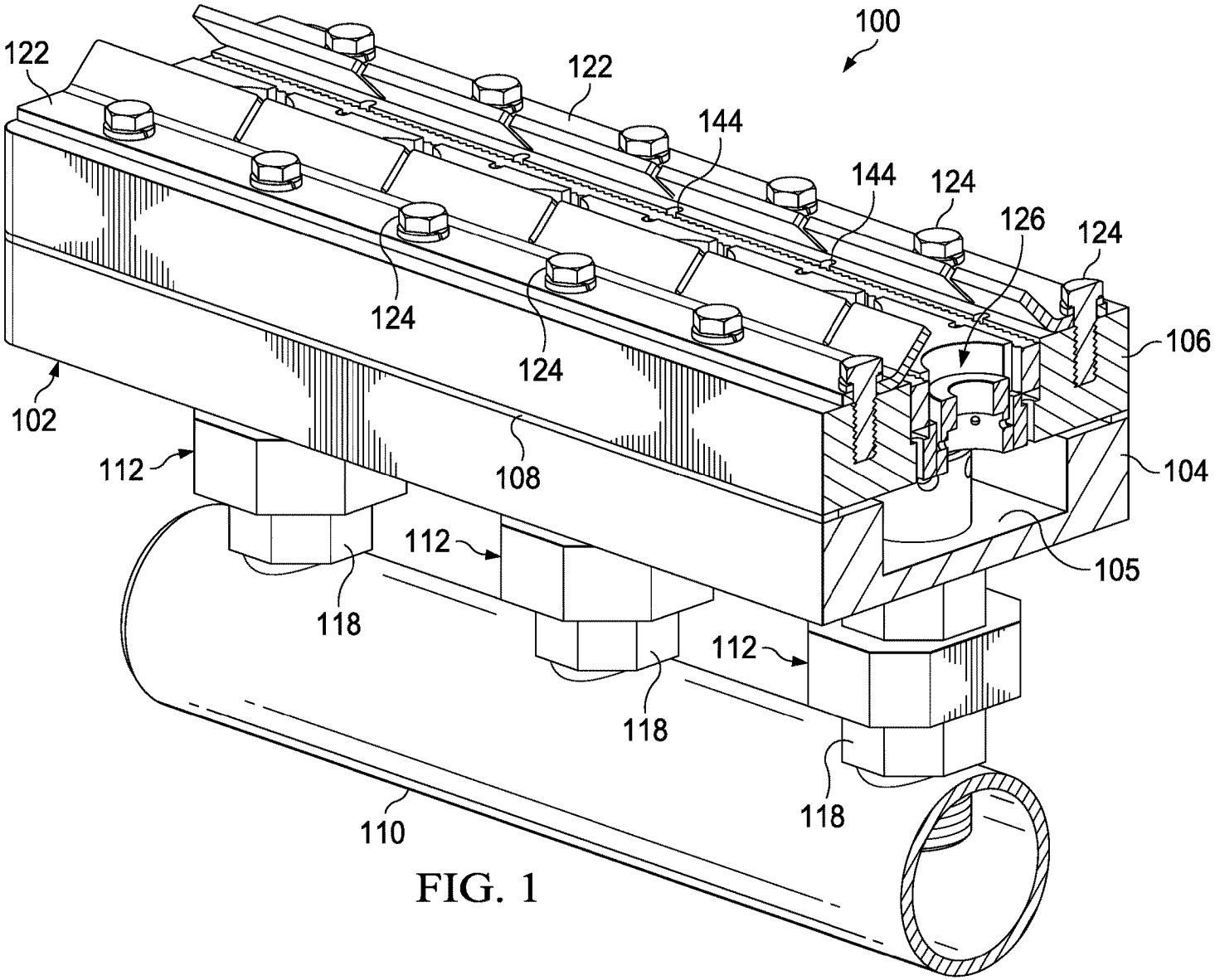
FIG. 1 is an oblique side view showing a partial cross-section of a burner assembly according to an embodiment of the disclosure.
Figure 2:
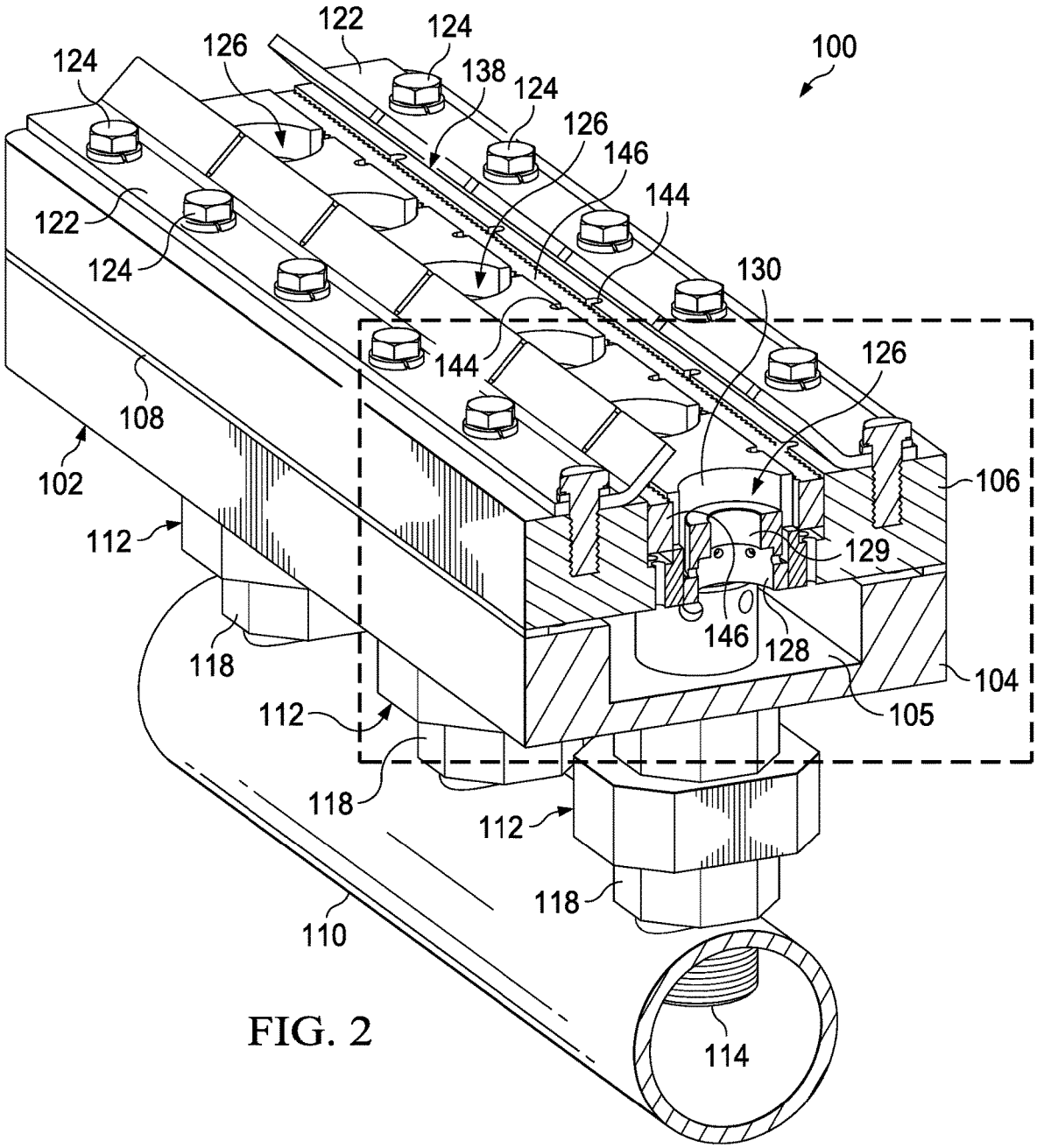
FIG. 2 is an oblique front view showing the partial cross-section of the burner assembly of FIG. 1 according to an embodiment of the disclosure.
Figure 3:
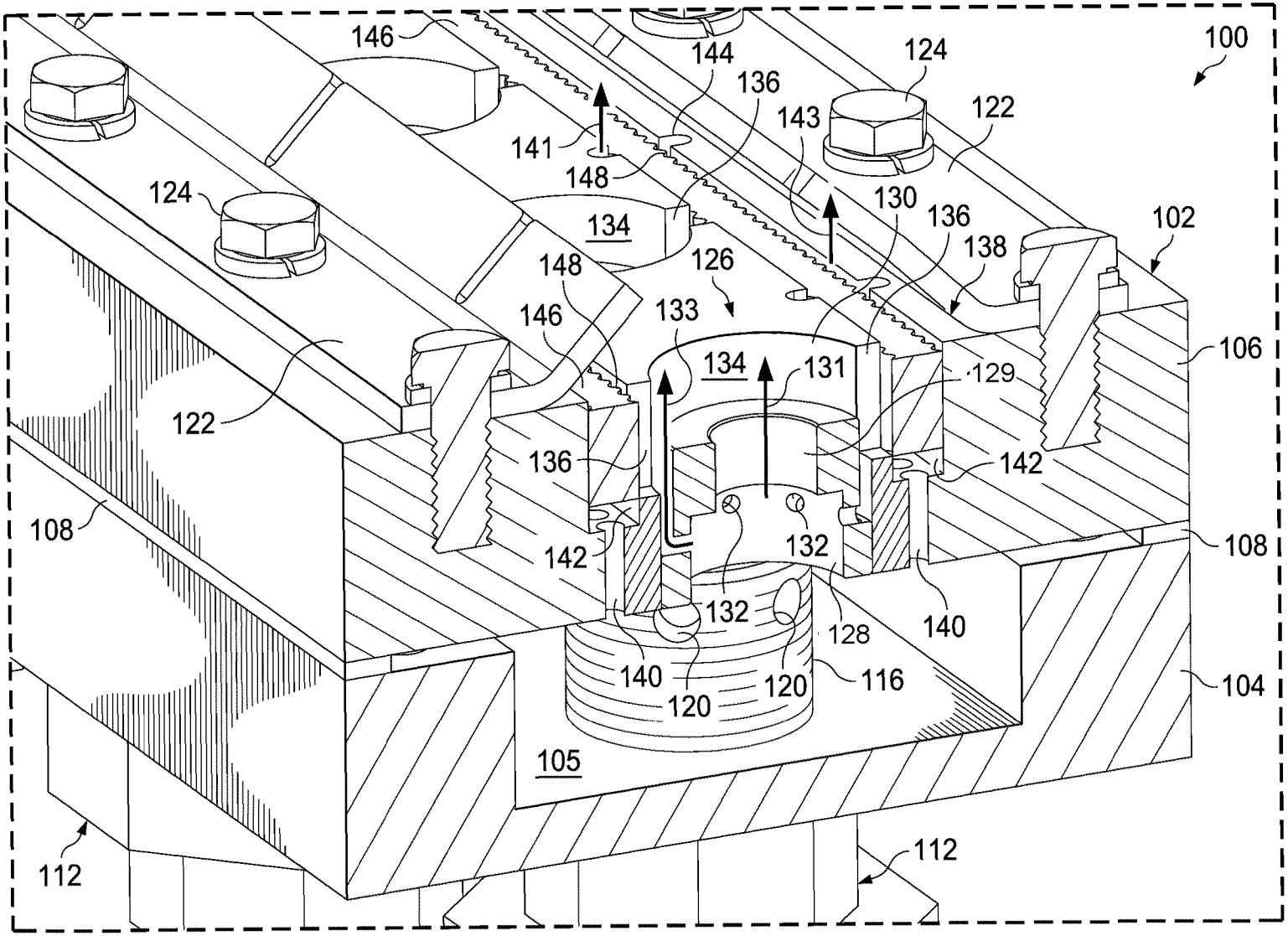
FIG. 3 is a detailed oblique front view of the partial cross-section of the burner assembly of FIGS. 1-2 according to an embodiment of the disclosure.
Figure 4:
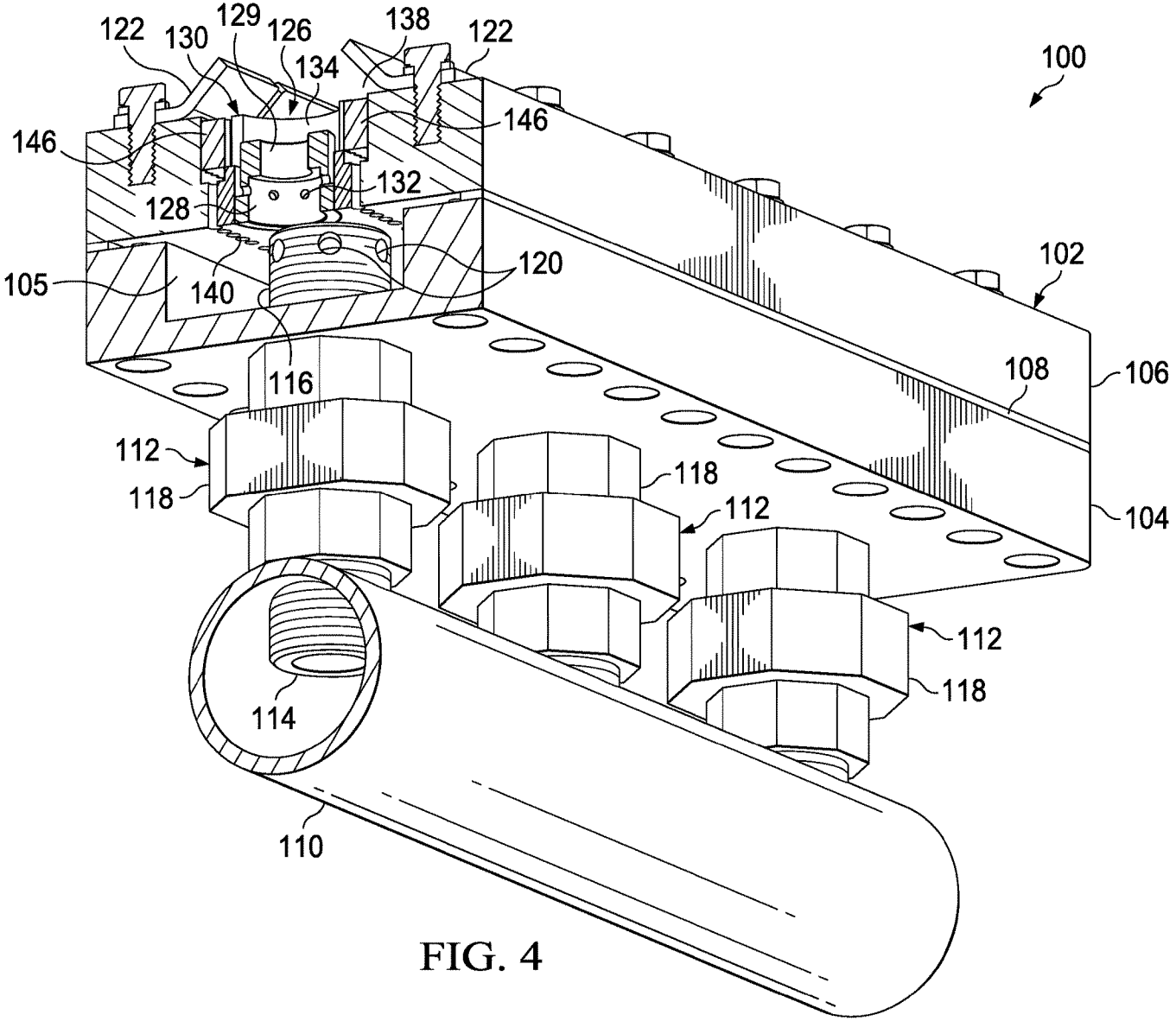
FIG. 4 is an oblique bottom view showing the partial cross-section of the burner assembly of FIGS. 1-3 according to an embodiment of the disclosure.
Figure 5:
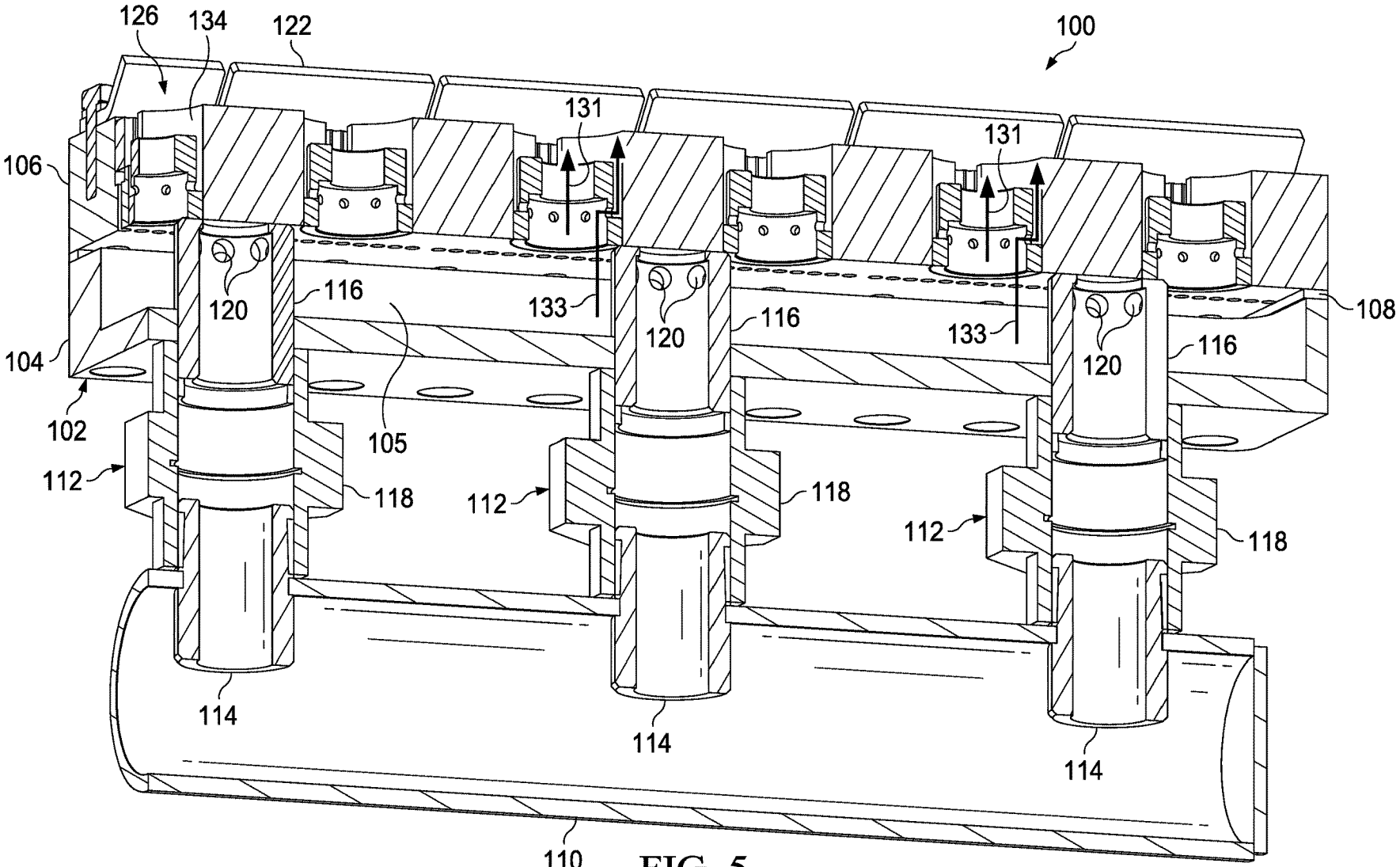
FIG. 5 is an oblique cross-sectional right side view showing the partial cross-section of the burner assembly of FIGS. 1-4 according to an embodiment of the disclosure.

In some cases, it may be desirable to provide a cooking system with a burner assembly having a high velocity burner to force combusted air and fuel through a heat exchanger and a low velocity burner to maintain a continuous combustion process and prevent so-called "lift off" where a flame and/or combustion process may be extinguished by a high velocity combustion process that exceeds the ignition capabilities of the burner. For example, where a heat exchanger comprises a plurality of compactly-arranged tubes comprising a plurality of fluid circuits, resistance to fluid flow through a fluid duct of the heat exchanger may be excessive, such that traditional burners would fail to pass combusted air and fuel through the heat exchanger and would suffer from "lift off" if the velocity and/or flowrate of combustion was increased. Accordingly, a cooking system is disclosed herein that comprises providing a burner assembly with a high velocity burner configured to provide the necessary high velocity flowrate through a heat exchanger having a first fluid circuit having a plurality of compactly-arranged tubes disposed perpendicularly and interstitially to a second fluid circuit having a plurality of compactly-arranged tubes and a low velocity burner configured to significantly reduce and/or substantially eliminate "lift off" that could result from operation of only the high velocity burner.

Referring now to FIGS. 1-5, various views of a burner assembly 100 are shown according to an embodiment of the disclosure. The burner assembly 100 generally comprises a body 102, a manifold 110, a plurality of runners 112 joining the body 102 to the manifold 110, a plurality of first burners 126, a plurality of second burners 138, a ribbon burner 146, and a plurality of deflectors 122. The body 102 comprises a lower portion 104 joined to an upper portion 106. In some embodiments, the lower portion 104 may be bolted to the upper portion 106 using fasteners 124 disposed through holes in the lower portion 104 and threaded into the upper portion 106. In some embodiments, a gasket 108 may be disposed between the lower portion 104 and the upper portion 106 of the body 102 to prevent leakage and/or seepage of any fluid flowing within the cavity 105 from escaping between the lower portion 104 and the upper portion 106. When assembled, the lower portion 104 and the upper portion 106 generally form a cavity 105 through which fuel and/or an air/fuel mixture may flow.

The burner assembly 100 also comprises a manifold 110 configured to deliver the fuel and/or the air/fuel mixture into the cavity 105 through a plurality of parallel runners 112. Each runner 112 comprises a lower threaded portion 114, an upper threaded portion 116, and a butt joint 118 that joins the lower threaded portion 114 to the upper threaded portion 116. In some embodiments, it will be appreciated that each runner 112 may be a solid piece and comprise the lower threaded portion 114 and the upper threaded portion 116 joined by the butt joint 118. The lower threaded portion 114 may generally be threaded into and extend into an inner opening of the manifold 110, such that fuel and/or an air/fuel mixture may flow from an internal volume of the manifold 110 through an internal volume of the lower threaded portion 114 and into an internal volume of the butt joint 118. The upper threaded portion 116 may generally be threaded into the lower portion 104 of the body 102 and extend into the cavity 105 of the body 102. Accordingly, an internal volume of the upper threaded portion 116 may receive fuel and/or an air/fuel mixture from the internal volume of the butt joint 118. It will be appreciated that each runner 112 thus comprises a fluid flow path that extends through internal volumes of the lower threaded portion 114, the butt joint 118, and the upper threaded portion 116. Furthermore, the upper threaded portion 116 comprises a plurality of fuel delivery holes 120 that may distribute the fuel and/or the air/fuel mixture received from the manifold 110 evenly throughout the cavity 105. Additionally, in some embodiments, an upper distal end of the upper threaded portion 116 may be closed and/or substantially abut a substantially flat surface of the upper portion 106 of the body 102 so that the fuel and/or the air/fuel mixture that passes through the runner 112 only escapes the upper threaded portion 116 through the fuel delivery holes 120.

The burner assembly 100 comprises a plurality of first burners 126 arranged adjacently along a length of the upper portion 106 of burner assembly 100. Additionally, the plurality of first burners 126 are arranged along a centerline of the upper portion 106 of the body 102, such that the centerline of the body 102 intersects a center axis of each first burner 126. Each first burner 126 comprises a cylindrically-shaped first bore 128 configured to receive the fuel and/or the air/fuel mixture from the cavity 105. The first bore 128 also comprises a plurality of holes 132 disposed about the first bore 128 that are configured to allow the fuel and/or the air/fuel mixture to flow from the first bore 128 to a combustion chamber 134 that is formed by a cylindrically-shaped third bore 130. Each first burner 126 also comprises a cylindrically-shaped second bore 129 that is axially aligned with and disposed downstream from the first bore 128 with respect to the flow of the fuel and/or the air/fuel mixture through the burner assembly 100 and that comprises a diameter that is smaller than the diameter of the first bore 128. The second bore 129 may also receive the fuel and/or the air/fuel mixture from the first bore 128. In some embodiments, the smaller diameter of the second bore 129 may be sized to control a pressure drop through the second bore 129 and/or the plurality of holes 132 disposed about the first bore 128.

Accordingly, the first burner 126 may define a first flowpath 131 from the cavity 105 through the first bore 128 and the second bore 129 into the combustion chamber 134 and further define a plurality of second flowpaths 133 from the cavity 105 through the first bore 128, through the plurality of holes 132, and into the combustion chamber 134. Furthermore, as will be discussed herein in further detail, to ignite the fuel and/or the air/fuel mixture in the first burner 126, each first burner 126 also comprises a groove 136 disposed in the third bore 130 that forms the cylindrically-shaped combustion chamber 134 on each of an opposing left side and right side of the combustion chamber 134 so that fuel through the first flowpath 131 and the plurality of second flowpaths 133 of the first burner 126 may be ignited by the ribbon burner 146. In some embodiments, the flowrate and/or volume of the fuel and/or the air/fuel mixture through the first flowpath 131 of the first burner 126 may be greater than the flowrate and/or volume of the fuel and/or the air/fuel mixture through the plurality of second flowpaths 133 through the first burner 126. However, in other embodiments, the flowrate and/or volume of the fuel and/or the air/fuel mixture through the first flowpath 131 of the first burner 126 may be equal to or less than the flowrate and/or volume of the fuel and/or the air/fuel mixture through the plurality of second flowpaths 133 through the first burner 126.

The burner assembly 100 also comprises a plurality of second burners 138 disposed on each of a left side and a right side of the upper portion 106 of the body 102 of burner assembly 100. Each second burner 138 may generally be configured as a low flow-rate ribbon burner 146 that comprises a plurality of feeder holes 140, a cavity 142, and a plurality of upper holes 144. The feeder holes 140 are configured to receive the fuel and/or the air/fuel mixture from the cavity 105 and allow the fuel and/or the air/fuel mixture to flow into a cavity 142 that houses the ribbon burner 146. The second burner 138 also comprises a plurality of upper holes 144 that are disposed on the left and right sides of the cavity 142 and the ribbon burner 146. The upper holes 144 receive fuel and/or the air/fuel mixture from the cavity 142. Accordingly, the second burner 138 may define a first flowpath 141 from the cavity 105 through a plurality of feeder holes 140, into the cavity 142, and through a plurality of upper holes 144. Furthermore, as will be discussed herein in further detail, the fuel and/or the air/fuel mixture flowing through the upper holes 144 may be ignited by the ribbon burner 146.

Additionally, the ribbon burner 146 comprises a plurality of small perforations 148 that may also allow fuel and/or the air/fuel mixture to pass through a plurality of second flowpaths 143 from the cavity 142 through the perforations 148, where they may be ignited by the ribbon burner 146. In some embodiments, the flowrate and/or volume of the fuel and/or the air/fuel mixture through the first flowpath 141 of the second burner 138 may be greater than the flowrate and/or volume of the fuel and/or the air/fuel mixture through the plurality of second flowpaths 143 through the second burner 138. However, in other embodiments, the flowrate and/or volume of the fuel and/or the air/fuel mixture through the first flowpath 141 of the second burner 138 may be equal to or less than the flowrate and/or volume of the fuel and/or the air/fuel mixture through the plurality of second flowpaths 143 through the second burner 138. Additionally, in some embodiments, the combined flowrate and/or volume of the fuel and/or the air/fuel mixture through a first burner 126 may be greater than the flowrate and/or volume of the fuel and/or the air/fuel mixture through a second burner 138. However, in alternative embodiments, the combined flowrate and/or volume of the fuel and/or the air/fuel mixture through a first burner 126 may be equal to or less than the flowrate and/or volume of the fuel and/or the air/fuel mixture through a second burner 138.

In some embodiments, the burner assembly 100 may comprise one or more infrared burners. Accordingly, the first burner 126, the second burner 138, and/or the ribbon burner 146 may be configured as an infrared burner. Accordingly, first burner 126, the second burner 138, and/or the ribbon burner 146 may comprise additional components, including but not limited to, ceramic components and/or other components necessary to configure and/or operate the first burner 126, the second burner 138, and/or the ribbon burner 146 as an infrared burner. However, in some embodiments, the first burner 126, the second burner 138, and/or the ribbon burner 146 may alternatively be configured as any other suitable burner.

In operation, the burner assembly 100 is configured to combust fuel and/or an air/fuel mixture through a plurality of first burners 126 and a plurality of second burners 138. In some embodiments, the burner assembly 100 may also comprise a separate igniter and/or a plurality of igniters configured to ignite the air/fuel mixture in each of the first burners 126 and the second burners 138. In this embodiment, the combined flowrate and/or volume of the fuel and/or air/fuel mixture through the first burners 126 is greater than the flowrate and/or volume of the fuel and/or the air/fuel mixture through the plurality of second burners 138. Accordingly, the velocity of the combusted fuel and/or the combusted air/fuel mixture through the first burners 126 is higher than the velocity of the combusted fuel and/or the combusted air/fuel mixture through the second burners 138.

Because the velocity of the combusted fuel and/or combusted air/fuel mixture through the first burners 126 exits the first burners 126 at such a high velocity, traditional burners may experience so-called "lift off" where the flame is extinguished due to the high velocity. As such, the lower velocity of the combusted fuel and/or the combusted air/fuel mixture exiting the second burners 138 may prevent this "lift off" by continuously burning fuel at a lower flowrate and/or delivering a combusted air/fuel mixture at the lower velocity. Additionally, the burner assembly 100 also comprises a deflector 122 on each of a left side and a right side of the upper portion 106 of the body 102 of burner assembly 100 that is secured to the upper portion 106 of the body 102 by a plurality of fasteners 124. The deflectors 122 may be angled towards a center of the upper portion 106 and extend over the second burners 138 in order to deflect the combusted air/fuel mixture exiting the second burners 138 towards the combusted air/fuel mixture exiting the first burners 126. Accordingly, the deflectors 122 may also aid in preventing "lift off" by directing the lower velocity combusted air/fuel mixture exiting the second burners 138 towards the higher velocity combusted air/fuel mixture exiting the first burners 126.

Figure 6:
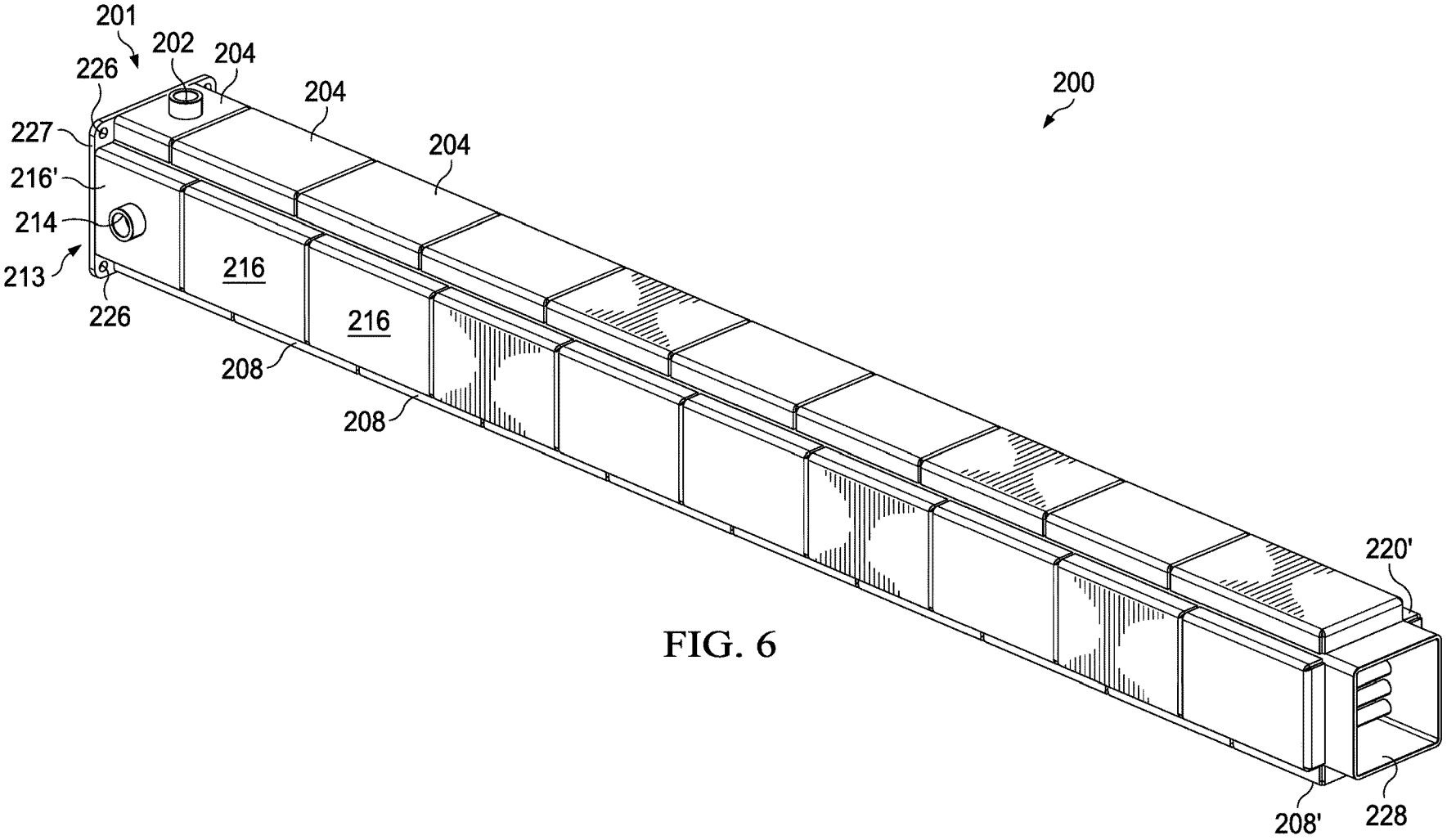
FIG. 6 is an oblique side view of a heat exchanger according to an embodiment of the disclosure.
Figure 7:
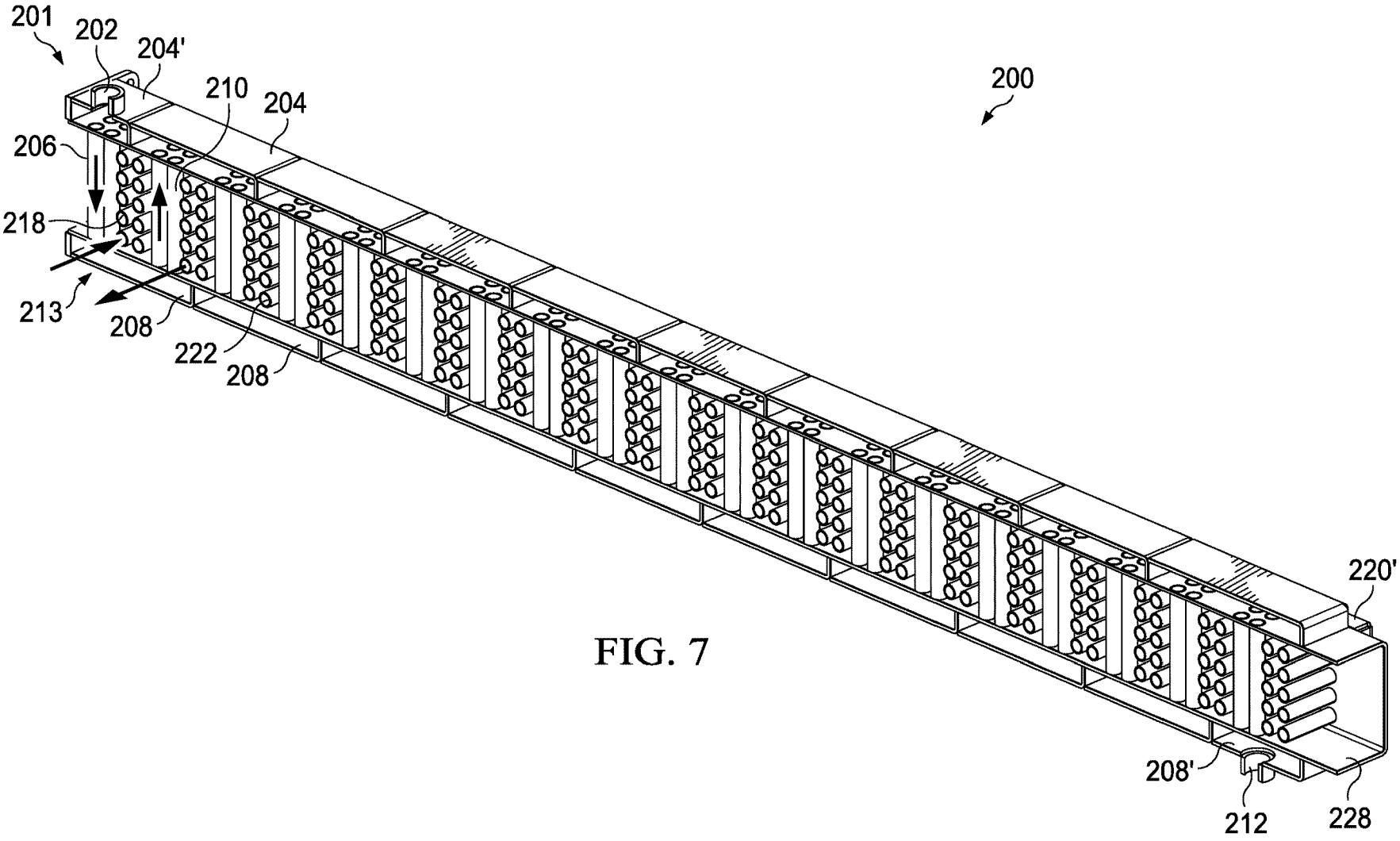
FIG. 7 is an oblique cross-sectional side view of the heat exchanger of FIG. 6 according to an embodiment of the disclosure.
Figure 8:
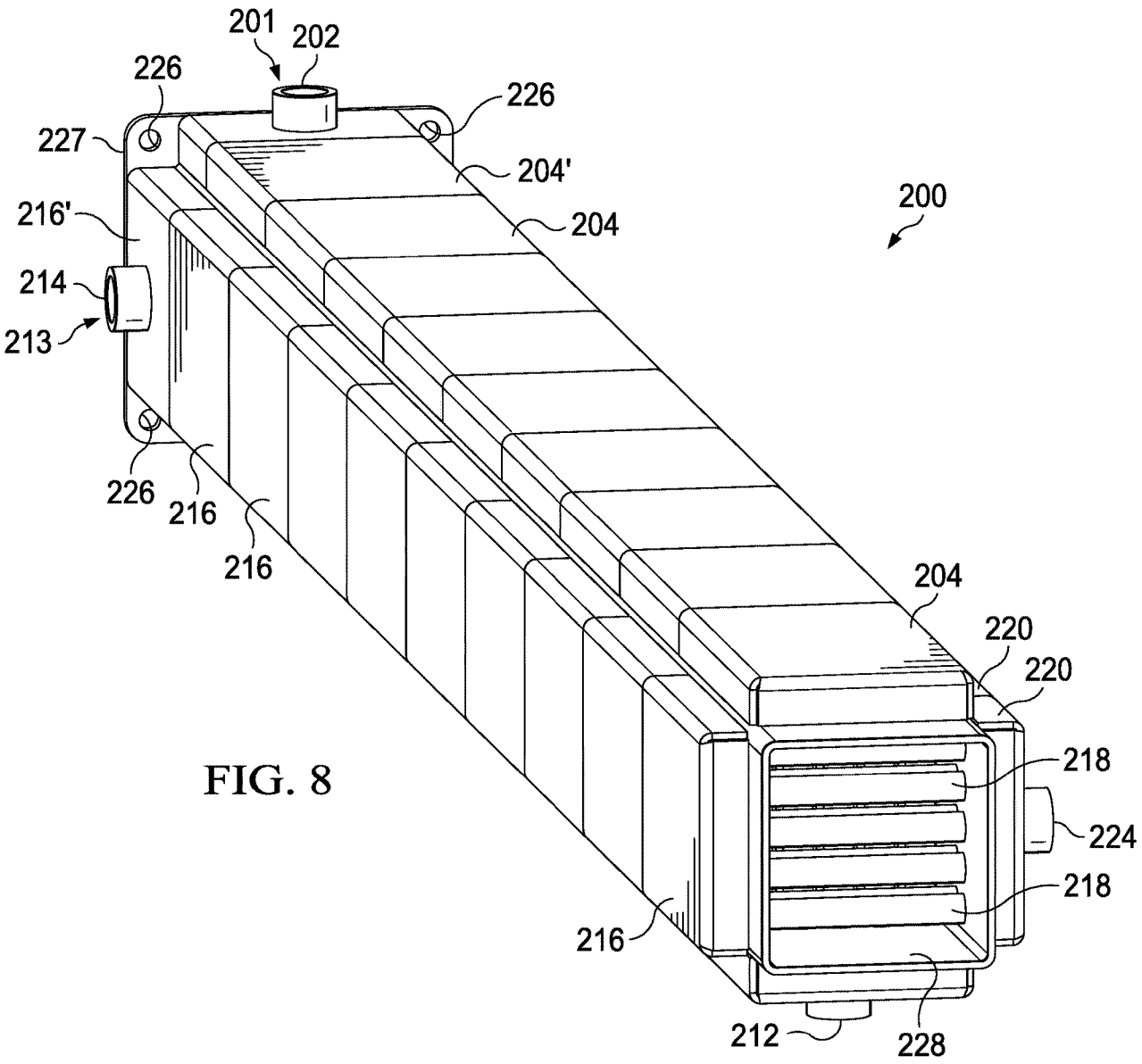
FIG. 8 is an oblique cross-sectional end view of the heat exchanger of FIGS. 6-7 according to an embodiment of the disclosure.

Referring now to FIGS. 6-8, an oblique side view, an oblique cross-sectional side view, and an oblique end view of a heat exchanger 200 are shown, respectively, according to an embodiment of the disclosure. The heat exchanger 200 comprises a first fluid circuit 201 having a first inlet 202, a plurality of top headers 204, a plurality of downward tubes 206, a plurality of bottom headers 208, a plurality of upward tubes 210, and a first outlet 212. The first inlet 202 is connected in fluid communication with a first top header 204' and is configured to receive a fluid therethrough and allow the fluid to enter the first top header 204'. The first top header 204' is connected in fluid communication with a first set of downward tubes 206, which is connected in fluid communication with a bottom header 208. Fluid from the first top header 204' may flow through the first set of downward tubes 206 into a bottom header 208. The bottom header 208 may also be connected in fluid communication with a set of upward tubes 210 that may carry fluid from the bottom header 208 through the upward tubes 210 and into another top header 204. Accordingly, this pattern may continue along the length of the heat exchanger 200, such that each top header 204 transfers fluid through a set of downward tubes 206 into a bottom header 208 and subsequently from the bottom header 208 through a set of upward tubes 210 into an adjacently downstream located top header 204.

Furthermore, it will be appreciated that downward tubes 206 may be associated with carrying a fluid from a top header 204 in a downward direction towards and into a bottom header 208, and upward tubes 210 may be associated with carrying a fluid from a bottom header 208 in an upward direction towards and into a top header 204. This pattern may continue along the length of the heat exchanger 200 until a last set of downward tubes 206 carries fluid through into a final bottom header 208' and out of the first outlet 212. Accordingly, the first fluid circuit 201 comprises passing fluid from the first inlet 202 into the first top header 204' through a repetitive serpentine series of downward tubes 206, a bottom header 208, a set of upward tubes 210, and a top header 204 until passing through a final set of downward tubes 206 into the final bottom header 208' and exiting the heat exchanger 200 through the first outlet 212. Furthermore, in other embodiments, it will be appreciated that the first inlet 202 and/or the first outlet 212 may alternatively be disposed both in a top header 204, both in a bottom header 208, or in opposing top and bottom headers 204, 208.

The heat exchanger 200 also comprises a second fluid circuit 213 having a second inlet 214, a plurality of left headers 216, a plurality of rightward tubes 218, a plurality of right headers 220, a plurality of leftward tubes 222, and a second outlet 224. The rightward tubes 218 and the leftward tubes 222 may be oriented substantially perpendicular to the downward tubes 206 and the upward tubes 210 of the first fluid circuit 201. The second inlet 214 is connected in fluid communication with a first left header 216' and is configured to receive a fluid therethrough and allow the fluid to enter the first left header 216'. The first left header 216' is connected in fluid communication with a first set of rightward tubes 218, which is connected in fluid communication with a right header 220. Fluid from the first left header 216' may flow through the first set of rightward tubes 218 into a right header 220. The right header 220 may also be connected in fluid communication with a set of leftward tubes 222 that may carry fluid from the right header 220 through the leftward tubes 222 and into another left header 216. Accordingly, this pattern may continue along the length of the heat exchanger 200, such that each left header 216 transfers fluid through a set of rightward tubes 218 into a right header 220 and subsequently from the right header 220 through a set of leftward tubes 222 into an adjacently downstream located left header 216.

Furthermore, it will be appreciated that rightward tubes 218 may be associated with carrying a fluid from a left header 216 in a rightward direction towards and into a right header 220, and leftward tubes 222 may be associated with carrying a fluid from a right header 220 in a leftward direction towards and into a left header 216. This pattern may continue along the length of the heat exchanger 200 until a last set of rightward tubes 218 carries fluid through into a final right header 220' and out of the second outlet 224. Accordingly, the second fluid circuit 213 comprises passing fluid from the second inlet 214 into the first left header 216' through a repetitive serpentine series of a set of rightward tubes 218, a right header 220, a set of leftward tubes 222, and a left header 216 until passing through a final set of rightward tubes 218 into the final right header 220' and exiting the heat exchanger 200 through the second outlet 224. Furthermore, in other embodiments, it will be appreciated that the second inlet 214 and/or the second outlet 224 may alternatively be disposed both in a left header 216, both in a right header 220, or in opposing left and right headers 216, 220. Additionally, it will be appreciated that in some embodiments, the heat exchanger 200 may comprise only one of the first fluid circuit 201 and the second fluid circuit 213.

Furthermore, it will be appreciated that the first fluid circuit 201 and the second fluid circuit 213 may comprise different lengths. Accordingly, the first inlet 202 and/or the first outlet 212 may be disposed in any of the top headers 204 or bottom headers 208, and the second inlet 214 and/or the second outlet 224 may be disposed in any of the left headers 216 and the right headers 220 to vary the length of the fluid circuits 201, 213, respectively. By altering the length of the fluid circuits 201, 213, the heat exchanger 200 may be configured to maintain a temperature gradient, reduce a pressure drop, and/or otherwise control the temperature and/or pressure of the fluid though each of the fluid circuits 201, 213.

The tubes 206, 210, 218, 222 of the heat exchanger 200 may generally be arranged to provide a compact, highly resistive flowpath through the fluid duct 228. In order to effectively and/or evenly distribute the heat produced by burner assembly 100 through the tubes 206, 210, 218, 222, sets and/or rows of tubes 206, 210 may be interstitially and/or alternatively spaced with sets and/or rows of tubes 218, 222. In the shown embodiment, two rows of downward tubes 206, two rows of rightward tubes 218, two rows of upward tubes 210, and two rows of leftward tubes 222 are interstitially and/or alternatively spaced, respectively, along the length of the heat exchanger 200. However, in alternative embodiments, a single row of tubes 206, 210, 218, 222 may be interstitially and/or alternatively spaced, respectively, along the length of the heat exchanger 200. In other embodiments, however, heat exchanger 200 may comprise any number of rows of tubes 206, 210, 218, 222 interstitially and/or alternatively spaced along the length of the heat exchanger 200. For example, heat exchanger 200 may comprise three rows of downward tubes 206, two rows of rightward tubes 218, three rows of upward tubes 210, and two rows of leftward tubes 222 may be interstitially and/or alternatively spaced. Accordingly, it will be appreciated that the number of rows of tubes 206, 210, 218, 222 interstitially and/or alternatively spaced may vary, so long as at least one row of vertically-oriented tubes 206, 210 is disposed adjacently with at least one row of horizontally-oriented tubes 218, 222 along the length of the heat exchanger 200.

The heat exchanger 200 also comprises a plurality of mounting holes 226 disposed through a mounting flange 227 that is disposed at the distal end of the heat exchanger 200 located closest to the first inlet 202 and the second inlet 214. The mounting holes 226 may generally be configured to mount the heat exchanger 200 to the burner assembly 100 of FIGS. 1-5. In some embodiments, the heat exchanger 200 may be secured to the burner assembly 100 via fasteners 124. However, in other embodiments, the heat exchanger 200 may be secured to the burner assembly 100 through an alternative mechanical interface. The heat exchanger 200 is secured to the burner assembly 100 so that combusted fuel and/or combusted air/fuel mixture is forced through a plurality of inner walls of the heat exchanger 200 that form a fluid duct 228 through the heat exchanger 200. Accordingly, heat from the combusted fuel and/or the combusted air/fuel mixture may be absorbed by a fluid flowing through the tubes 206, 210, 218, 222 of the heat exchanger 200. The heated fluid may exit the heat exchanger 200 through the first outlet 212 and the second outlet 224 of the first fluid circuit 201 and the second fluid circuit 213, respectively, and therefore be used to heat and/or cook consumable products (i.e. chips, crackers, frozen foods).

In operation, the configuration of tubes 206, 210, 218, 222 provides a compact, highly resistive flowpath through the fluid duct 228. Accordingly, to force combusted fuel and/or combusted air/fuel mixture through the fluid duct 228 requires high velocity. Accordingly, the velocity of the combusted fuel and/or the combusted air/fuel mixture through the first burners 126 of the burner assembly 100 is high enough to provide the requisite velocity needed to overcome the resistance to flow through the heat exchanger 200. Furthermore, the lower velocity of the combusted fuel and/or the combusted air/fuel mixture through the second burners 138 of the burner assembly 100 prevents "lift off" so that the combustion process remains constant through the burner assembly 100.

Figure 9:
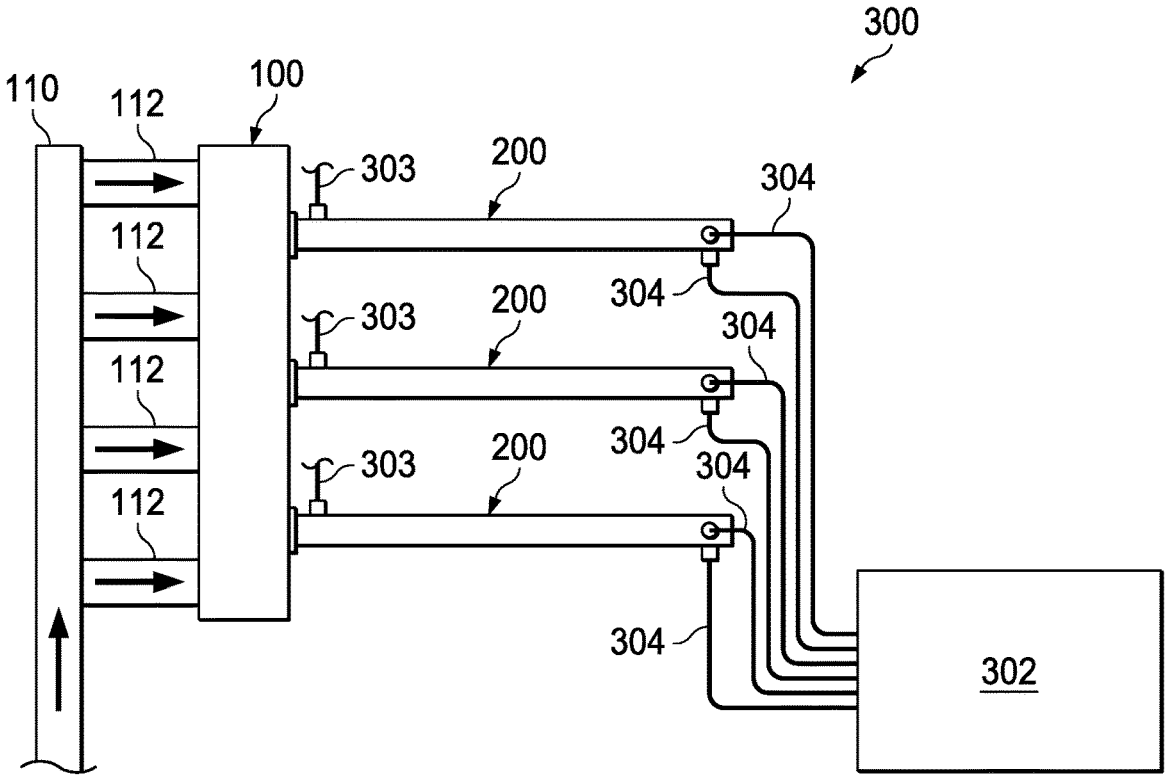
FIG. 9 is a schematic of a cooking system according to an embodiment of the disclosure.

Referring now to FIG. 9, a schematic of a cooking system 300 is shown according to an embodiment of the disclosure. Cooking system 300 generally comprises at least one burner assembly 100, at least one heat exchanger 200, at least one cooking vessel 302 (e.g. a fryer), at least one oil input line 303, and at least one oil output line 304. As previously disclosed, the burner assembly 100 may be mounted to at least one heat exchanger 200. However, in this embodiment, the burner assembly 100 may be mounted to a plurality of heat exchangers 200. Furthermore, while not shown, in some embodiments, multiple burner assemblies 100 may be mounted to multiple heat exchangers 200 in the cooking system 300. The burner assembly 100 is configured to provide a high velocity flow of combusted fuel and/or combusted air/fuel mixture through the fluid duct 228 of the heat exchangers 200.

Fluid, such as a cooking fluid (e.g. oil) may be pumped into the first inlet 202 and/or the second inlet 214 of the heat exchangers 200 through a plurality of oil input lines 303, each oil input line 303 being associated with a respective inlet 202, 214. Fluid may enter the oil input lines 303 from a reservoir and/or may be circulated through the heat exchangers 200 from the cooking vessel 302. The fluid may be pumped and/or passed through the tubes 206, 210, 218, 222 of the heat exchangers 200. Heat produced from the combustion of fuel and/or an air/fuel mixture in the burner assembly 100 may be transferred to the fluid flowing through the tubes 206, 210, 218, 222 of the heat exchangers 200. The heated fluid may exit the heat exchanger 200 through the first outlet 212 and the second outlet 224 and be carried into the cooking vessel 302 through a plurality of oil output lines 304, each oil output line 304 being associated with a respective outlet 212, 224. In some embodiments, the heated fluid may be carried into the cooking vessel 302 at different locations to maintain a proper temperature, temperature gradient, and/or temperature profile within the cooking vessel 302. As stated, in some embodiments, fluid from the cooking vessel 302 may be recirculated through the oil input lines 303 and reheated within the heat exchangers 200. Furthermore, it will be appreciated while burner assembly 100 is disclosed in the context of food service equipment (e.g. fryer, boiler), the burner assembly 100 may be used for any application or industry that requires a fluid to be heated rapidly, consistently, and efficiently.

Figure 10:
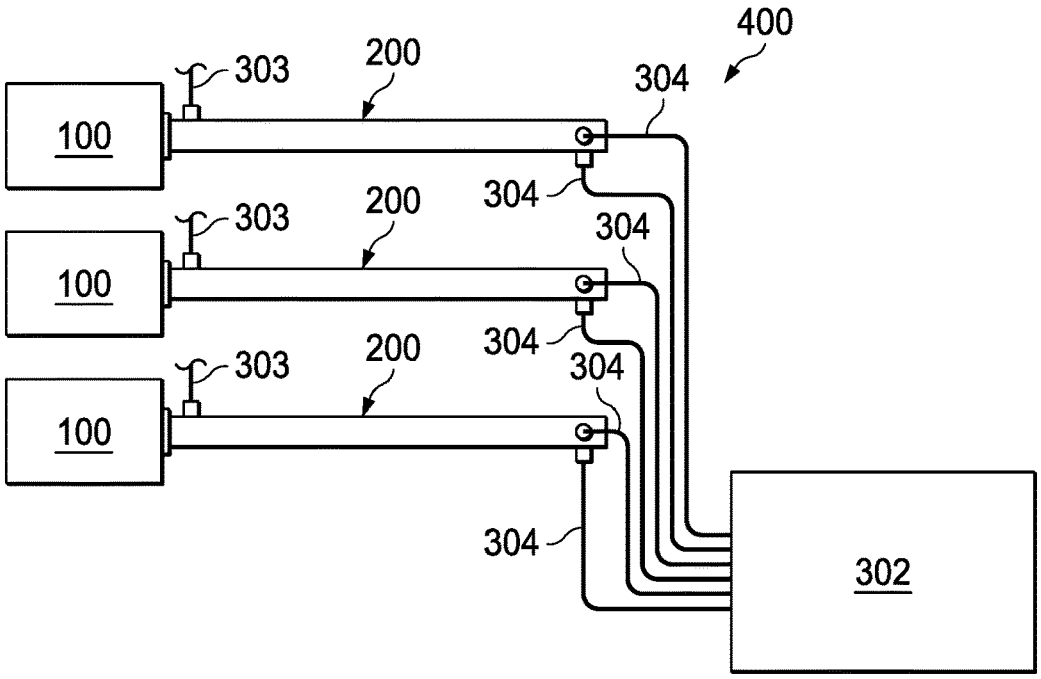
FIG. 10 is a schematic of a cooking system according to another embodiment of the disclosure.

Referring now to FIG. 10, a schematic of a cooking system 400 is shown according to another embodiment of the disclosure. Cooking system 400 may be substantially similar to cooking system 300 of FIG. 9. However, cooking system 400 comprises a plurality of burner assemblies 100, a plurality of heat exchangers 200, at least one cooking vessel 302 (i.e., a fryer), at least one oil input line 303 per heat exchanger 200, and at least one oil output line 304 per heat exchanger 200. As previously disclosed, each burner assembly 100 may be associated with at least one heat exchanger 200. However, in this embodiment, each burner assembly 100 may be mounted to a single heat exchanger 200. Each burner assembly 100 is configured to provide a high velocity flow of combusted fuel and/or combusted air/fuel mixture through the fluid duct 228 of the associated heat exchanger 200.

Fluid, such as a cooking fluid (e.g. oil) may be pumped into the first inlet 202 and/or the second inlet 214 of the heat exchanger 200 through a plurality of oil input lines 303, each oil input line 303 being associated with a respective inlet 202, 214. Fluid may enter the oil input lines 303 from a reservoir and/or may be circulated through the heat exchangers 200 from the cooking vessel 302. The fluid may be pumped and/or passed through the tubes 206, 210, 218, 222 of the heat exchanger 200. Heat produced from the combustion of fuel and/or an air/fuel mixture in the burner assemblies 100 may be transferred to the fluid flowing through the tubes 206, 210, 218, 222 of each respective heat exchanger 200. The heated fluid may exit the heat exchangers 200 through the first outlet 212 and the second outlet 224 of each heat exchanger 200 and be carried into the cooking vessel 302 through a plurality of oil output lines 304, each oil output line 304 being associated with a respective outlet 212, 224.

In some embodiments, the heated fluid may be carried into the cooking vessel 302 at different locations to maintain a proper temperature, temperature gradient, and/or temperature profile within the cooking vessel 302. Furthermore, it will be appreciated that each burner assembly 100 may be individually controlled by a burner controller (not pictured). As such, in some embodiments, each burner assembly 100 may be operated at substantially similar temperatures. However, in other embodiments, each burner assembly 100 may be operated at different temperatures to maintain a temperature gradient across the cooking vessel 302 and/or to control a cooking process requiring different temperatures. Still further, while multiple burner assemblies 100 and multiple heat exchangers 200 are pictured, in some embodiments, a single burner assembly 100 may be associated with a single heat exchanger 200 to provide heated fluid to the cooking vessel 302. As stated, in some embodiments, fluid from the cooking vessel 302 may be recirculated through the oil input lines 303 and reheated within the heat exchangers 200. Furthermore, it will be appreciated while burner assembly 100 is disclosed in the context of food service equipment (e.g. fryer, boiler), the burner assembly 100 may be used for any application or industry that requires a fluid to be heated rapidly, consistently, and efficiently.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Unless otherwise stated, the term "about" shall mean plus or minus 10 percent of the subsequent value. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A cooking system comprising:

a burner assembly comprising a burner including a first bore, a second bore, and a third bore that are concentrically aligned, wherein the second bore is fluidly coupled between the first bore and the third bore, wherein the first bore includes a plurality of holes disposed along a circumference of the first bore, wherein each hole extends directly into the third bore, and wherein the third bore includes a combustion chamber;

a heat exchanger configured to receive a combusted fuel and/or a combusted air/fuel mixture from the burner assembly; and a cooking vessel fluidly coupled to the heat exchanger, wherein, the heat exchanger comprises:

a duct that is configured to receive combusted fuel and/or combusted air/fuel mixture from the burner assembly;

a first fluid circuit fluidly coupled to the cooking vessel, the first fluid circuit including:

top headers positioned on a top side of the duct;

bottom headers positioned on a bottom side of the duct;

upward tubes fluidly coupled to the bottom headers and the top headers, wherein the upward tubes are downstream from the bottom headers, wherein the upward tubes are positioned within the duct; and downward tubes fluidly coupled to the top headers and the bottom headers, wherein the downward tubes are downstream from the top headers, wherein the downward tubes are positioned within the duct; and a second fluid circuit fluidly coupled to the cooking vessel, the second fluid circuit including:

left headers positioned on a left side of the duct;

right headers positioned on a right side of the duct;

rightward tubes fluidly coupled to the left headers and the right headers, wherein the rightward tubes are downstream from the left headers; and leftward tubes fluidly coupled to the right headers and the left headers, wherein the leftward tubes are downstream from the right headers.

2. The cooking system of claim 1, wherein the first fluid circuit further comprises a first inlet fluidly coupled to a top header, wherein the first inlet is fluidly coupled to the cooking vessel, wherein the cooking vessel contains a cooking fluid.

3. The cooking system of claim 1, wherein the first fluid circuit further comprises a first inlet fluidly coupled to a bottom header, wherein the first inlet is fluidly coupled to the cooking vessel, wherein the cooking vessel contains a cooking fluid.

4. The cooking system of claim 1, wherein the first fluid circuit further comprises a first outlet fluidly coupled to a top header, wherein the first outlet is fluidly coupled to the cooking vessel, wherein the cooking vessel contains a cooking fluid.

5. The cooking system of claim 1, wherein the first fluid circuit further comprises a first outlet fluidly coupled to a bottom header, wherein the first outlet is fluidly coupled to the cooking vessel, wherein the cooking vessel contains a cooking fluid.

6. The cooking system of claim 1, wherein the second fluid circuit further comprises a second inlet fluidly coupled to a left header, wherein the second inlet is fluidly coupled to the cooking vessel, wherein the cooking vessel contains a cooking fluid.

7. The cooking system of claim 1, wherein the second fluid circuit further comprises a second inlet fluidly coupled to a right header, wherein the second inlet is fluidly coupled to the cooking vessel, wherein the cooking vessel contains a cooking fluid.

8. The cooking system of claim 1, wherein the second fluid circuit further comprises a second outlet fluidly coupled to a left header, wherein the second outlet is fluidly coupled to the cooking vessel, wherein the cooking vessel contains a cooking fluid.

9. The cooking system of claim 1, wherein the second fluid circuit further comprises a second outlet fluidly coupled to a right header, wherein the second outlet is fluidly coupled to the cooking vessel, wherein the cooking vessel contains a cooking fluid.

10. A cooking system comprising:

a burner assembly including:

a plurality of first burners, each including a first bore, a second bore, and a third bore that are concentrically aligned, wherein for each first burner:

the first bore includes a plurality of holes disposed along a circumference of the first bore, each hole extends directly into the third bore, and the third bore includes a combustion chamber;

wherein each first burner comprises a first flow path configured to emit fuel or air/fuel mixture into the combustion chamber at a first flow rate, the first flow path extends from the first bore, through the second bore, and into the third bore, and a plurality of second flow paths configured to emit fuel or air/fuel mixture into the combustion chamber at a second flow rate that is less than the first flow rate, the plurality of second fluid flow paths extends from the first bore, through the plurality of holes, and into the third bore;

a heat exchanger fluidly coupled to the combustion chamber of each of the plurality of first burners; and a cooking vessel fluidly coupled to the heat exchanger, wherein the first bore of each of the first burners is in fluid communication with a cavity, wherein the burner assembly comprises a ribbon burner that is in fluid communication with the cavity, and wherein the burner assembly comprises a deflector that is configured to deflect combusted fuel and/or combusted air/fuel mixture emitted from the ribbon burner toward combusted fuel and/or combusted air/fuel mixture emitted from the plurality of first burners.

11. The cooking system of claim 10, wherein the second bore is disposed within the third bore.

12. The cooking system of claim 1, wherein the burner comprises a first flow path configured to emit fuel or air/fuel mixture into the combustion chamber at a first flow rate, and a plurality of second flow paths configured to emit fuel or air/fuel mixture into the combustion chamber at a second flow rate that is less than the first flow rate.

13. The cooking system of claim 12, wherein the first flow path extends from the first bore, through the second bore, and into the third bore; and wherein the plurality of the second flow paths extend from the first bore through the plurality of holes and into the third bore.

14. A cooking system comprising:

a burner assembly including:

a plurality of first burners, each including a first bore, a second bore, and a third bore that are concentrically aligned, wherein for each first burner:

the first bore includes a plurality of holes disposed along a circumference of the first bore, each hole extends directly into the third bore, and the third bore includes a combustion chamber;

wherein each first burner comprises a first flow path configured to emit fuel or air/fuel mixture into the combustion chamber at a first flow rate, the first flow path extends from the first bore, through the second bore, and into the third bore, and a plurality of second flow paths configured to emit fuel or air/fuel mixture into the combustion chamber at a second flow rate that is less than the first flow rate, the plurality of second fluid flow paths extends from the first bore, through the plurality of holes, and into the third bore;

a heat exchanger fluidly coupled to the combustion chamber of each of the plurality of first burners; and a cooking vessel fluidly coupled to the heat exchanger, wherein the heat exchanger comprises:

a duct that is configured to receive combusted fuel and/or combusted air/fuel mixture from the burner assembly;

a first fluid circuit fluidly coupled to the cooking vessel, the first fluid circuit including:

top headers positioned on a top side of the duct;

bottom headers positioned on a bottom side of the duct;

upward tubes fluidly coupled to the bottom headers and the top headers, wherein the upward tubes are downstream from the bottom headers, wherein the upward tubes are positioned within the duct; and downward tubes fluidly coupled to the top headers and the bottom headers, wherein the downward tubes are downstream from the top headers, wherein the downward tubes are positioned within the duct; and a second fluid circuit fluidly coupled to the cooking vessel, the second fluid circuit including:

left headers positioned on a left side of the duct;

right headers positioned on a right side of the duct;

rightward tubes fluidly coupled to the left headers and the right headers, wherein the rightward tubes are downstream from the left headers; and leftward tubes fluidly coupled to the right headers and the left headers, wherein the leftward tubes are downstream from the right headers.

* * * * *